US009797084B2

(12) United States Patent
Kim

(10) Patent No.: US 9,797,084 B2
(45) Date of Patent: Oct. 24, 2017

(54) WASHING MACHINE

(71) Applicant: LG ELECTRONICS INC., Seoul (KR)

(72) Inventor: Hyunseok Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 24 days.

(21) Appl. No.: 14/987,350

(22) Filed: Jan. 4, 2016

(65) Prior Publication Data

US 2016/0194809 A1 Jul. 7, 2016

(30) Foreign Application Priority Data

Jan. 5, 2015 (KR) ..... 10-2015-0000526

(51) Int. Cl.

| | |
|---|---|
| ***D06F 39/02*** | (2006.01) |
| ***D06F 25/00*** | (2006.01) |
| ***D06F 58/20*** | (2006.01) |
| *D06F 39/12* | (2006.01) |

(52) U.S. Cl.

CPC ..... *D06F 39/02* (2013.01); *D06F 25/00* (2013.01); *D06F 58/20* (2013.01); *D06F 39/12* (2013.01)

(58) Field of Classification Search

None

See application file for complete search history.

(56) References Cited

U.S. PATENT DOCUMENTS

| | | | | |
|---|---|---|---|---|
| 2,722,751 | A * | 11/1955 | Weston | D06F 58/22 34/608 |
| 4,531,387 | A * | 7/1985 | Cotton | D06F 29/00 312/139.2 |
| 2005/0097925 | A1* | 5/2005 | Kim | D06F 9/028 68/12.18 |
| 2005/0262885 | A1 | 12/2005 | Byun et al. | |
| 2006/0016092 | A1* | 1/2006 | Kim | D06F 58/20 34/130 |
| 2009/0288687 | A1* | 11/2009 | Marone | A47L 15/4409 134/93 |
| 2014/0260384 | A1* | 9/2014 | Millett | F25D 21/08 62/155 |

FOREIGN PATENT DOCUMENTS

| | | | |
|---|---|---|---|
| CN | 1419004 | A | 5/2003 |
| CN | 1496425 | A | 5/2004 |
| CN | 1724744 | A | 1/2006 |
| CN | 103797178 | A | 5/2014 |
| DE | 10245281 | A1 | 4/2004 |
| EP | 1314809 | A2 | 5/2003 |
| KR | 20100110504 | A * | 10/2010 |
| KR | 1020100110504 | A | 10/2010 |
| WO | 2013032224 | A2 | 3/2013 |

* cited by examiner

*Primary Examiner* — Joseph L Perrin
*Assistant Examiner* — Cristi Tate-Sims
(74) *Attorney, Agent, or Firm* — Dentons US LLP

(57) ABSTRACT

A washing machine is disclosed. The washing machine includes a tub, an air supply unit, which is disposed over the tub so as to heat and circulate air in the tub, a detergent dispenser, which is disposed over the tub, a dispenser cover for opening the detergent dispenser, and a thermal shield member for preventing heat generated from the air supply unit from being directly transferred to the dispenser cover.

9 Claims, 10 Drawing Sheets

-RELATED ART-

WASHING MACHINE

CROSS REFERENCE TO RELATED APPLICATIONS

This application claims the benefit of Korean Patent Application No. 10-2015-0000526, filed on Jan. 5, 2015, which is incorporated by reference for all purposes as if fully set forth herein.

BACKGROUND

Field

The present disclosure relates to a washing machine, and more particularly to a washing machine, which is provided on the upper surface thereof with a detergent dispenser which includes a dispenser cover for opening and closing the detergent dispenser.

Discussion of the Related Art

Generally, a washing machine can be a drying apparatus for drying laundry, a washing apparatus for washing laundry and the like. The washing machine, and in particular, the washing apparatus, uses detergent and the like to wash laundry. To accomplish this, the washing apparatus is typically provided with a detergent dispenser.

Initially, a conventional detergent dispenser is briefly described with reference to an accompanying drawing.

FIG. 1 is a perspective view showing a conventional washing machine and a detergent dispenser incorporated in the washing machine.

As shown in FIG. 1, a conventional washing machine 10 includes a cabinet 11 defining the appearance of washing machine 10, a tub (not shown), which is disposed in cabinet 11 so as to contain washing water, and a drum 12, which is rotatably disposed in the tub so as to contain and wash laundry introduced thereinto. The washing machine is provided with a detergent dispenser 20, which introduces detergent into drum 12 in order to improve the effectiveness with which laundry is washed.

Detergent dispenser 20 typically includes a drawer-type detergent receiver 22, which is partially drawn in the forward direction of washing machine 10. In operation, detergent is put into drawn detergent receiver 22, and detergent receiver 22 is mounted into detergent dispenser 20.

In other words, detergent dispenser 20 includes detergent receiver 22, and detergent introduced into detergent receiver 22 is supplied together with washing water to the tub or drum, which is a space for washing laundry.

To introduce detergent into detergent dispenser 20 of conventional washing machine 10, detergent dispenser 20 is maintained in state of being drawn outward from washing machine 10, and a user lifts a detergent container and introduces detergent into detergent dispenser.

Since detergent must be introduced into detergent dispenser 20 while detergent dispenser 20 is in the state of being drawn out from the front face of washing machine 10, a user has to introduce the detergent into detergent dispenser 20 while lifting the detergent container or while maintaining the spout of the detergent container on detergent dispenser 20.

However, when a user introduces the detergent into detergent dispenser 20 while lifting the detergent container, a user has to exert a great deal of force to lift up the detergent container, thereby being inconvenient to the user. Meanwhile, when a user introduces the detergent into detergent dispenser 20 while maintaining the spout of the detergent container on detergent dispenser 20, there is a problem in that detergent dispenser 20 may break due to the weight of the detergent container.

Furthermore, in the case of conventional detergent dispenser 20, detergent dispenser 20 must be drawn out from washing machine 10 in order to introduce the detergent. Accordingly, in order to allow detergent dispenser 20 to be drawn out from washing machine 10, detergent dispenser 20 must be provided on the front face of washing machine 10, thereby restricting the design of the front face of washing machine 10.

SUMMARY

Accordingly, the present disclosure is directed to a washing machine that substantially obviates one or more problems due to limitations and disadvantages of the related art.

One object is to provide a washing machine, in which the position of the detergent dispenser is changed and the structure of which is improved so as to allow a user to easily introduce detergent into the washing machine.

Another object is to provide a washing machine, which is constructed so as to prevent the heat from an air supply unit from being directly transferred to a dispenser cover adapted to open and close a detergent dispenser.

A further object is to provide a washing machine in which the detergent dispenser has an improved position and structure so as to reduce restrictions in the design of the washing machine.

Additional advantages, objects, and features will be set forth in part in the description which follows and in part will become apparent to those having ordinary skill in the art upon examination of the following, or may be learned from practice of embodiments of the invention. The objectives and other advantages may be realized and attained by the structure particularly pointed out in the written description and claims hereof as well as the appended drawings.

To achieve these objects and other advantages and in accordance with the purpose of the disclosure, as embodied and broadly described herein, a washing machine includes a tub, an air supply unit, disposed over the tub, to heat and circulate air in the tub, a detergent dispenser, disposed over the tub, a dispenser cover for opening the detergent dispenser, and a thermal shield member for preventing heat generated from the air supply unit from being directly transferred to the dispenser cover.

The washing machine may further include a cabinet including an upper cover defining the rear part of the upper surface of the washing machine, wherein the detergent dispenser is not covered by the upper cover, and the dispenser cover may be moved to a position under the upper cover so as to open the detergent dispenser.

The dispenser cover may include a bracket disposed over the detergent dispenser, and a sliding door, which is slidably coupled to the bracket and which slides so as to open and close the detergent dispenser.

The bracket may include a body part having a through hole, through which detergent is introduced into the detergent dispenser, and guide parts, which are provided on both lateral sides of the body part and have first and second guide slits formed in inner facing surfaces thereof for guiding the sliding door, wherein the sliding door includes first and second slide protrusions formed on respective lateral sides thereof, which are inserted into the first and second guide slits, respectively.

The first and second guide slits may be inclined downward in the direction in which the sliding door opens.

The second guide slits may have a greater angle of inclination than the first guide slits.

The front edge of the sliding door may constitute the front edge of the cabinet, and a connecting surface may be provided between the upper surface of the sliding door and the front cover of the cabinet so as to connect the upper surface of the sliding door to the front cover of the cabinet.

The air supply unit may include an introduction portion, disposed on the circumferential surface of the rear part of the tub, a discharge portion, disposed at the center of the front part of the tub, and a duct, connecting both the discharge portion and the introduction portion.

The dispenser cover may be positioned over the upper surface of the duct when the detergent dispenser is open.

The thermal shield member may be attached to the lower surface of the sliding door.

The thermal shield member may be attached to the lower surface of the sliding door with a predetermined gap therebetween.

The thermal shield member may be attached to the lower surface of the bracket.

The thermal shield member may be attached to the lower surface of the bracket with a predetermined gap therebetween.

In another aspect of the present invention, a washing machine includes a cabinet including an upper cover defining the rear part of the upper surface thereof, a tub disposed in the cabinet, an air supply unit, which is disposed over the tub so as to heat and circulate air in the tub, a detergent dispenser, which is disposed over the tub and is exposed by the upper cover, a dispenser cover, which is moved to a position under the upper cover, which is exposed by the upper cover, so as to open the detergent dispenser, and a thermal shield member for preventing heat generated from the air supply unit from being directly transferred to the dispenser cover.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the invention and together with the description serve to explain the principle of the invention. In the drawings.

DETAILED DESCRIPTION

Hereinafter, a washing machine according to an exemplary embodiment of the present invention is described in detail with reference to the accompanying drawings.

It should be noted that terms of components, which are defined in the description, are terms defined in consideration of their function in embodiments of the present invention. Therefore, the terms should not be construed as limiting the technical components of embodiments of the present invention. The terms, which are defined for respective components, may be referred to by other terms in the field.

The present disclosure is directed to a washing machine, and more particularly to a detergent dispenser.

The components of the disclosed washing machine other than the detergent dispenser are substantially identical to the components of a typical washing machine. However, it should be noted that the structural identity of the washing machine does not limit the technical ideas of the present disclosure. Therefore, general components of the washing machine will be briefly described, and the detergent dispenser will be described in detail.

The washing machine according to an embodiment of the present invention is first described in detail with reference to FIGS. 2 to 4.

Figure 1:
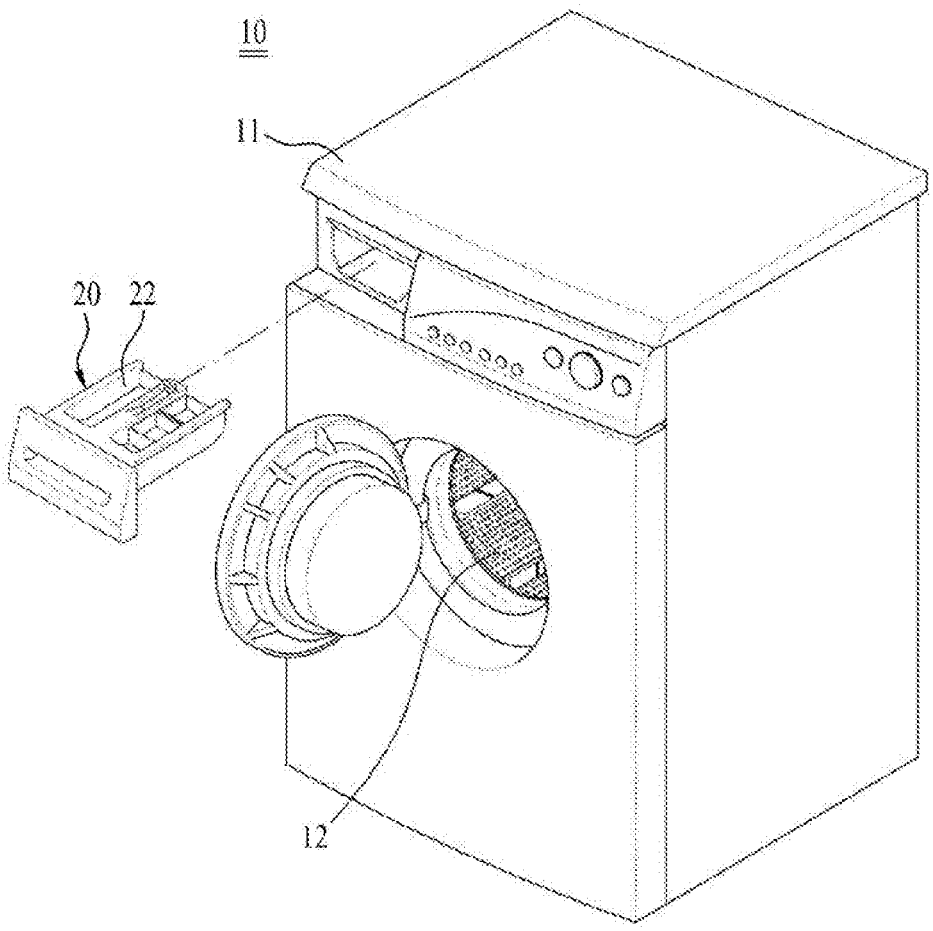
FIG. 1 is a perspective view showing a conventional washing machine.
Figure 2:
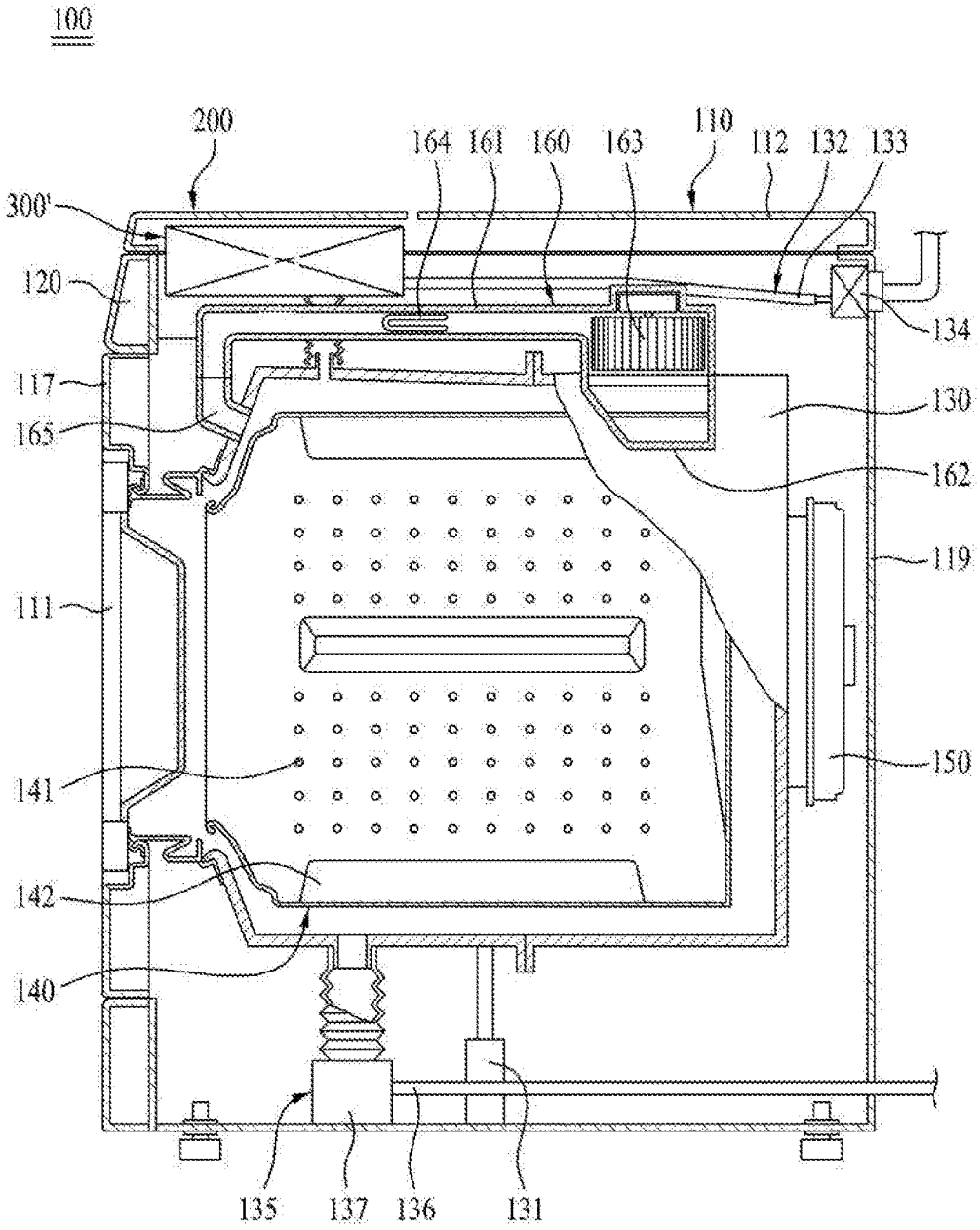
FIG. 2 is a schematic cross-sectional view showing a washing machine according to an exemplary embodiment of the present invention.
Figure 3:
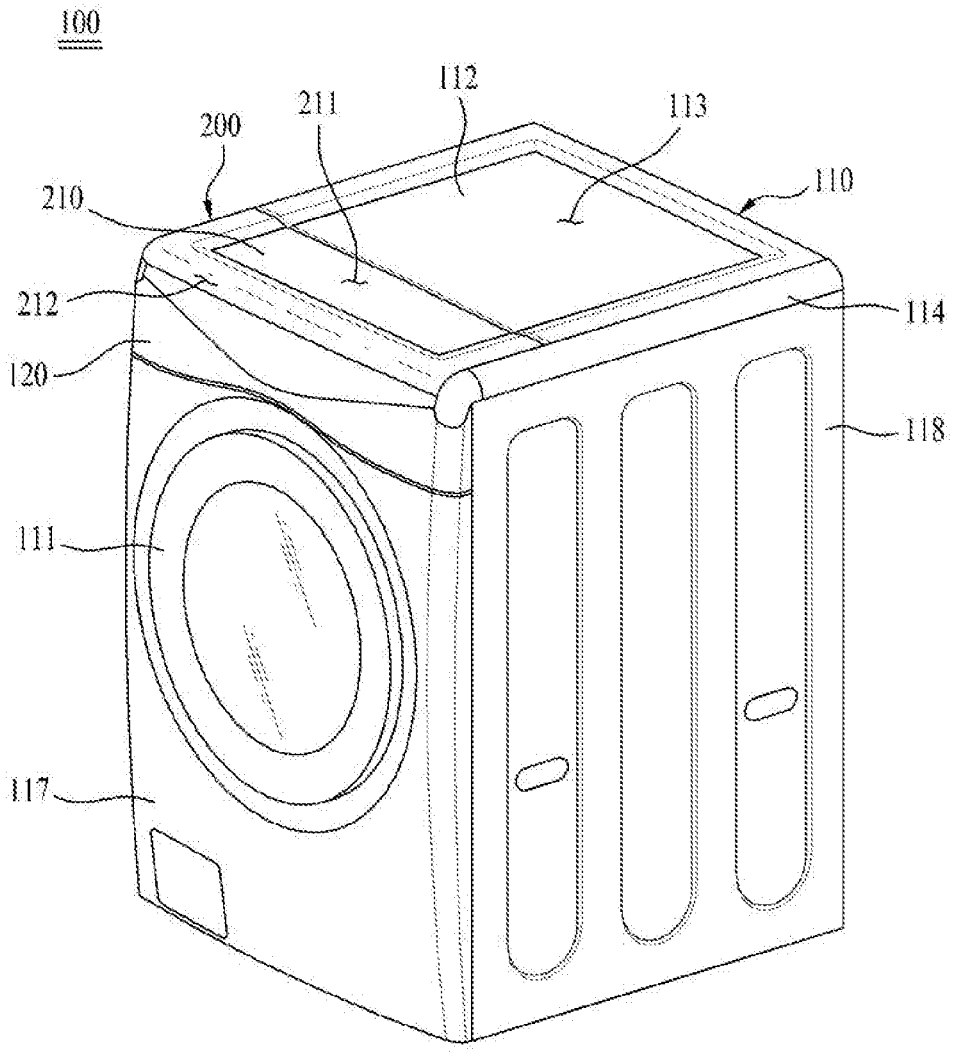
FIG. 3 is a perspective view showing the washing machine according to the embodiment of the present invention.

As shown in FIGS. 2 and 3, washing machine 100 according to an embodiment of the present invention includes a cabinet 110, which includes an upper cover 112, a front cover 117, two side covers 118 and a rear cover 119 so as to define the appearance of washing machine apparatus 100. Washing machine 100 further includes a tub 130, which is disposed in cabinet 110 so as to contain washing water, a drum 140 rotatably mounted in tub 130, an air supply unit 160 for heating and circulating air inside tub 130, a detergent dispenser 300', which is positioned over the front and upper part of tub 130 to receive detergent when not covered by upper cover 112, and a dispenser cover 200, which forms a continuous surface with upper cover 112 and covers detergent dispenser 300'.

Detergent dispenser 300' is mounted on the upper part of cabinet 110 such that detergent dispenser 300' is exposed by opening a portion of the upper part of cabinet 110. To this end, the upper part of cabinet 110 includes upper cover 112, which forms a portion of the upper surface of cabinet 110, and dispenser cover 200 for shielding or exposing detergent dispenser 300'.

Dispenser cover 200 defines the upper surface of cabinet 110 and the front edge of the upper surface of cabinet 110. Detergent dispenser 300', dispenser cover 200, sliding door 210, recessed surface 211, and connecting surface 212 will be described in detail below, after the description of washing machine 100.

Cabinet 110 is openably provided at the front face thereof with a door 111 for opening and closing the interior of cabinet 110. A control panel 120 is provided on the upper part of the front surface thereof with a control panel 120 through which a specific course, in which a washing procedure, a drying procedure and the like is executed, is input.

Control panel 120 includes a manipulation part (not shown) which allows a user to select the washing and drying operations, and a display part (not shown) for displaying the procedures selected by a user and the state of operation of washing machine 100.

Upper cover 112 of cabinet 110 includes a recessed surface 113, which is depressed in the inner area of upper cover 112 for the purpose of reinforcement, and a pair of side panels 114, which are disposed on both sides of the upper cover 112 so as to cover the gaps between side covers 118 and upper cover 112.

Tub 130 is intended to contain washing water in cabinet 110, and is provided at the rear part thereof with a motor 150 for rotating drum 140. A spring (not shown), a damper 131 and the like are provided between tub 130 and cabinet 110 so as to support tub 130 in a buffering manner.

Tub 130 is further provided with a water supply unit 132, which includes a water supply valve 134 and a water supply hose 133 for the supply of washing water, and a water discharge unit 135, which includes a water discharge pump 137 and a water discharge hose 136 for the discharge of washing water after the completion of washing of laundry.

Drum 140 is rotatably disposed in tub 130, and laundry is introduced into drum 140 through door 111. Drum 140 has therein a plurality of draining holes 141 through which washing water is discharged, and is provided on the inner surface thereof with lifts 142, which lift the laundry contained in drum 140 and then release the laundry so as to let it fall during the rotation of drum 140. Consequently, it is possible to improve the washing performance by virtue of the vigorous motion of laundry by lifts 142.

Washing machine 100 according to the embodiment may include an air supply unit 160 for fulfilling the drying function.

Air supply unit 160 serves to heat and circulate the air in tub 130 so as to supply the heated air to the inside of tub 130 and dry the laundry contained in drum 140. Air supply unit 160 includes an introduction portion 162 through which the air in tub 130 is introduced into air supply unit 160, a blower fan 163, which is disposed over introduction portion 162 so as to draw air into tub 130, a heater 164 for heating the air drawn in by blower fan 163 and a discharge portion 165 for supplying the air, heated by heater 164, to the inside of drum 140.

Introduction portion 162 is positioned at the outer surface of the rear part of tub 130 so as to allow the air in tub 130 to be introduced therethrough, and discharge portion 165 is connected to the center of the front part of tub 130 so as to allow the air to be directly discharged to the inside of drum 140.

Introduction portion 162 is connected to discharge portion 165 via a duct 161 (see FIG. 4) defining the path along which air flows. Heater 164 and blower fan 163 are preferably disposed in duct 161. Duct 161 is connected to both discharge portion 165 and introduction portion 162, extends to the center of the front part from a portion of the rear part of tub 130.

In consideration of the flow of air, it is preferable that the air discharged from blower fan 163 be heated by heater 164. The washing machine according to embodiments of the present invention is constructed such that air is directly drawn in and heated from the outer surface of tub 130 and is supplied to the front part of tub 130. The humid air, which has been used to dry laundry, may be condensed on the inner surface of tub 130, and may be converted into dry air due to the temperature difference between the inside of tub 130 and the outside of tub 130.

Alternatively, in order to convert humid air, which has been used to dry laundry, into dry air, some of the humid air in tub 130 may be discharged to the outside of tub 130, and dry air outside tub 130 may be introduced into tub 130.

Here, the components such as tub 130, drum 140, and air supply unit 160 may be embodied as components such as a tub, drum, and air supply unit according to the conventional art, or components such as a tub, drum and, air supply unit which are improved over the conventional art.

Discharge portion 165, which is provided in air supply unit 160 of washing machine 100, is positioned at an upper portion of the front part of tub 130, and duct 161 of air supply unit 160 extends to discharge portion 165 from a portion of the rear part of tub 130.

In order to prevent detergent dispenser 300' from interfering with discharge portion 165 or duct 161 of air supply unit 160, a detergent receiver 300 is provided at one side, deviating from the center of the front part of tub 130, and a subsidiary detergent receiver 500 is provided so as to be spaced apart from detergent receiver 300. In other words, a space T is defined between detergent receiver 300 and subsidiary detergent receiver 500 so as to accommodate discharge portion 165 or duct 161 of air supply unit 160.

Hereinafter, the detergent dispenser according to an embodiment of the present invention is described in detail with reference to FIGS. 4 and 5.

Figure 4:
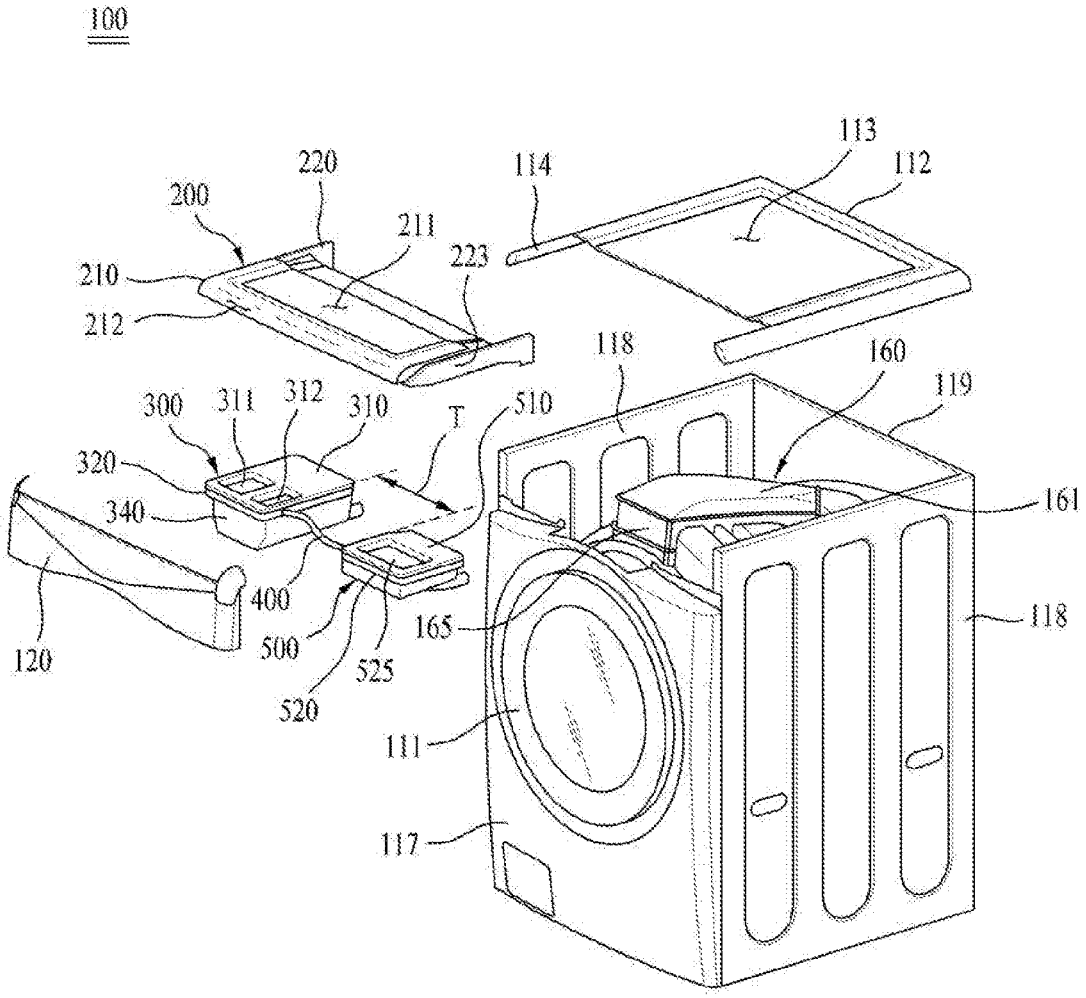
FIG. 4 is an exploded perspective view showing the upper structure of the washing machine according to the embodiment of the present invention.
Figure 5:
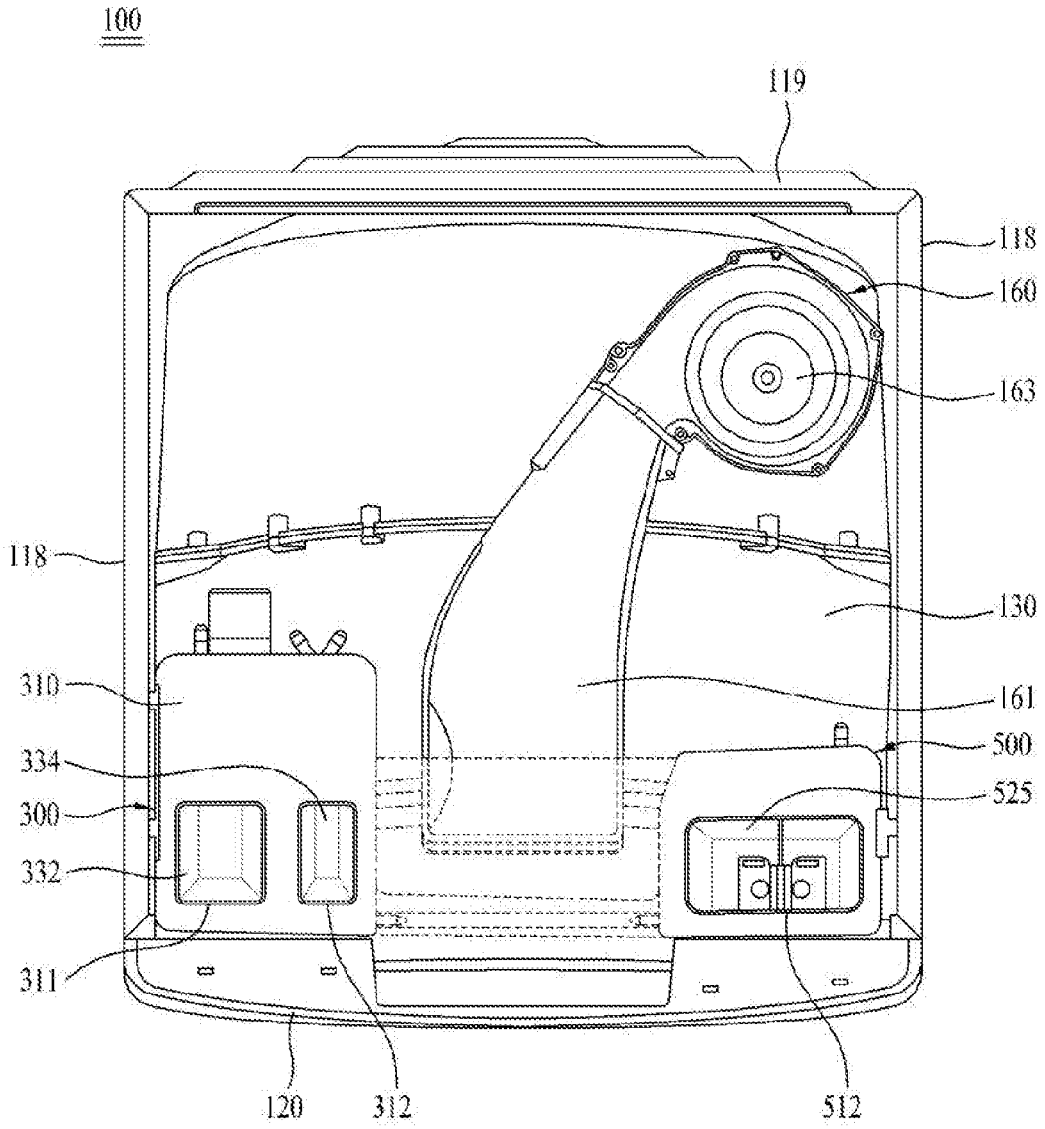
FIG. 5 is a plan view showing the internal structure of the washing machine according to the embodiment of the present invention.

As shown in FIGS. 4 and 5, detergent dispenser 300' includes detergent receiver 300, which is positioned at one side deviating from the front end of duct 161 and discharge portion 165 of air supply unit 160, and subsidiary detergent receiver 500, which is positioned at the opposite side deviating from the front end of duct 161 and discharge portion 165.

Here, detergent receiver 300 may receive powdered detergent (or liquid detergent) which is to wash laundry, preliminary detergent which is used to remove stains from laundry or the like, and subsidiary detergent receiver 500 may receive a bleaching agent, fabric softener, or the like which can be supplementarily used to wash laundry.

Detergent receiver 300 is provided with a first tub connecting hose (not shown), which is intended to supply tub 130 with the mixture of the detergent or the preliminary detergent received therein and washing water additionally provided thereinto, and subsidiary detergent receiver 500 is provided with a second tub connecting hose (not shown), which is intended to supply tub 130 with the mixture of the bleaching agent or fabric softener received therein and washing water additionally supplied thereinto.

Detergent receiver 300 includes a first cover 310, having therein a detergent introduction hole 311 through which detergent is introduced, and a preliminary detergent introduction hole 312, through which preliminary detergent is introduced, a first flow channel 320, which includes a detergent mixer 332, which is disposed under first cover 310 and contains detergent introduced through detergent introduction hole 311, and a preliminary detergent mixer 334, which contains preliminary detergent introduced through preliminary detergent introduction hole 312, and which supplies the contained detergent and preliminary detergent with water and mixes the detergent and preliminary detergent with the water, and a first water collector 340, for collecting the detergent and water (or the preliminary detergent and water), which were mixed with each other in first flow channel 320, and supplying the mixture to tub 130.

Detergent receiver 300 may further include a liquid detergent introduction guide (not shown) for mixing liquid detergent with water and supplying the mixture to tub 130 by virtue of a siphon phenomenon.

Subsidiary detergent receiver 500 includes a second cover 510 having therein an introduction hole 512 through which subsidiary detergent (e.g. bleaching agent, fabric softener or the like) is introduced, a second flow channel 520, which is positioned under second cover 510 and includes a storage 525 for storing subsidiary detergent introduced thereinto and which supplies the subsidiary detergent by virtue of a siphon phenomenon, and a second water collector (not shown) for collecting the bleaching agent or fabric softener stored in second flow channel 520 and supplying the same to tub 130.

First and second covers 310 and 510, first and second flow channels 320 and 520, and first water collector 340 and second water collector (not shown) may be individually fabricated, and may be coupled to each other by means of additional coupling structures, or may be integrally coupled to each other by means of thermal fusion.

Detergent receiver 300 and subsidiary detergent receiver 500 may be connected to each other via an additional connecting hose 400, and subsidiary detergent receiver 500 may receive washing water, supplied to detergent receiver 300, through connecting hose 400, and may supply subsidiary detergent to tub 130.

In other words, subsidiary detergent receiver 500 may receive washing water either through an additional water supply line (not shown) or through detergent receiver 300.

Discharge portion 165 of air supply unit 160 is positioned at the front part of tub 130, and duct 161 of air supply unit 160 extends to discharge portion 165 from a portion of the rear part of tub 130.

Accordingly, in order to prevent detergent dispenser 300' from interfering with discharge portion 165 of duct 161 of air supply unit 160, detergent dispenser 300' is not provided with an additional introduction hole over discharge portion 165 of air supply unit 160.

The operation of washing machine 100 is briefly described below. Washing water is introduced into tub 130 through water supply unit 132, and washing, rinsing, and dehydration procedures are executed by rotation of drum 140. During washing and rinsing procedures, washing water is discharged to the outside of tub 130 through water discharge unit 135. After the washing and rinsing procedures, the dehydration of laundry is executed, thereby completing the overall washing operation.

When a drying procedure is executed, the air in tub 130 is circulated by means of blower fan 163, and is heated by heater 164 of air supply unit 160.

The heated air dries laundry contained in drum 140 while circulating through tub 130 and air supply unit 160. The air, which has been used to dry laundry, condenses on the inner surface of tub 130 due to the temperature difference between the inside and the outside of tub 130, and is discharged to the outside of tub 130 by means of water discharge unit 135.

Before or during the operation of washing machine 100, detergent for washing laundry must be introduced into washing machine 100. In order to introduce detergent into washing machine 100, dispenser cover 200, which is provided at the upper part of washing machine 100, must be opened, and liquid detergent, powdered detergent, fabric softener, subsidiary detergent or the like must be selectively introduced into detergent dispenser 300'.

As shown in FIGS. 3 and 4, washing machine 100 according to an embodiment of the present invention, to which dispenser cover 200 is applied, is internally provided at an upper portion of the front part thereof with detergent dispenser 300' for introducing detergent into washing machine 100. The rear part of the upper surface of washing machine 100 is defined by upper cover 112, and dispenser cover 200, which slides into washing machine 100 so as to open and close detergent dispenser 300', is provided over the front part of the upper surface of washing machine 100 (particularly, over detergent dispenser 300').

Upper cover 112 and dispenser cover 200 collectively define the upper surface of washing machine 100 and extend so as to be continuous with each other, thereby offering a sense of unity.

In other words, dispenser cover 200, which is disposed to be adjacent to upper cover 112, defines a surface that is continuous with the upper surface of upper cover 112.

The pair of side panels 114, which are positioned on both lateral sides of upper cover 112, extend toward dispenser cover 200 so as to complete the appearance of both lateral sides of upper cover 112 and dispenser cover 200.

Dispenser cover 200 defines the front part of the upper surface of washing machine 100 and extends so as to be continuous with front cover 117 of washing machine 100. In other words, dispenser cover 200 defines part of the upper surface of washing machine 100, and connects the upper surface and the front surface of washing machine 100 via a connecting surface extending to front cover 117 of washing machine 100, thereby offering an aesthetically pleasing appearance.

Hereinafter, dispenser cover 200 according to the embodiment of the present invention is described in detail with respect to FIGS. 6 to 8.

Figure 6:
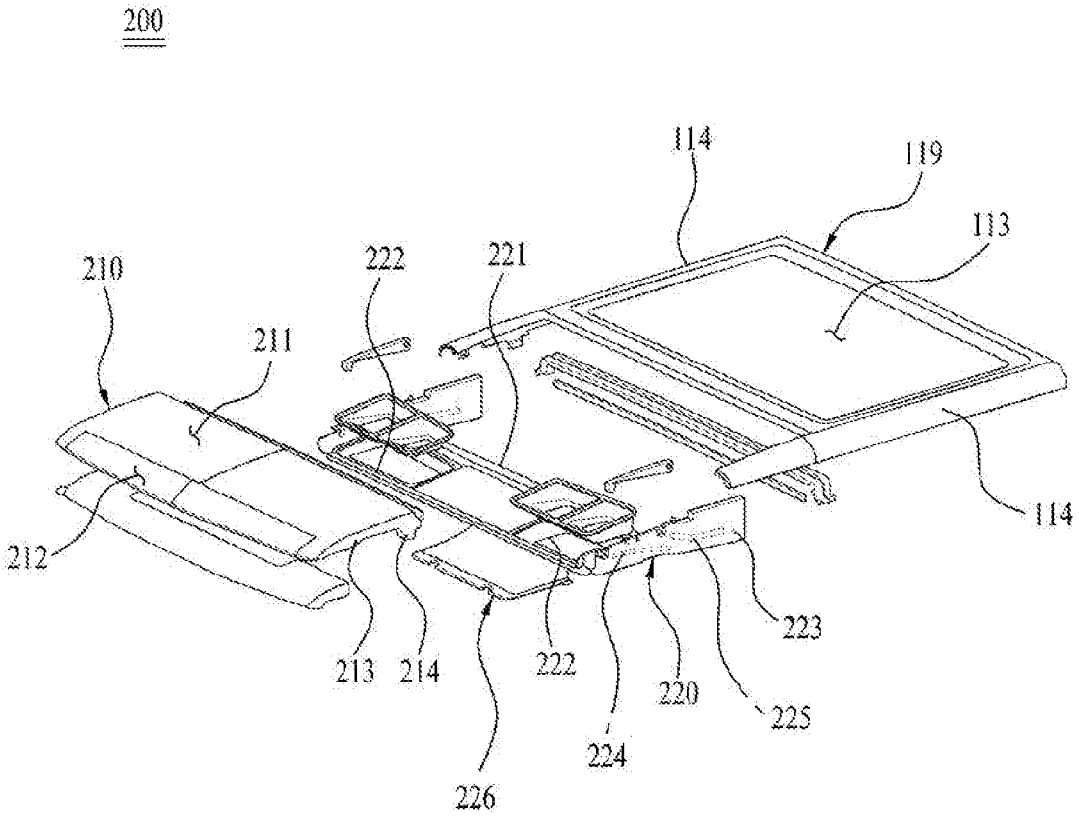
FIG. 6 is an exploded perspective view showing an upper panel and a dispenser cover of the washing machine according to the embodiment of the present invention.
Figure 7:
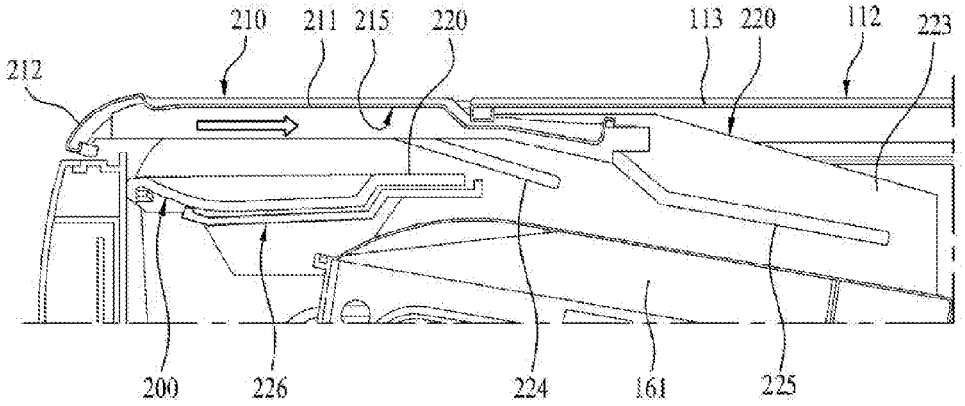
FIGS. 7 and 8 are cross-sectional views showing opening and closing motions of the dispenser cover of the washing machine according to the embodiment of the present invention.
Figure 8:
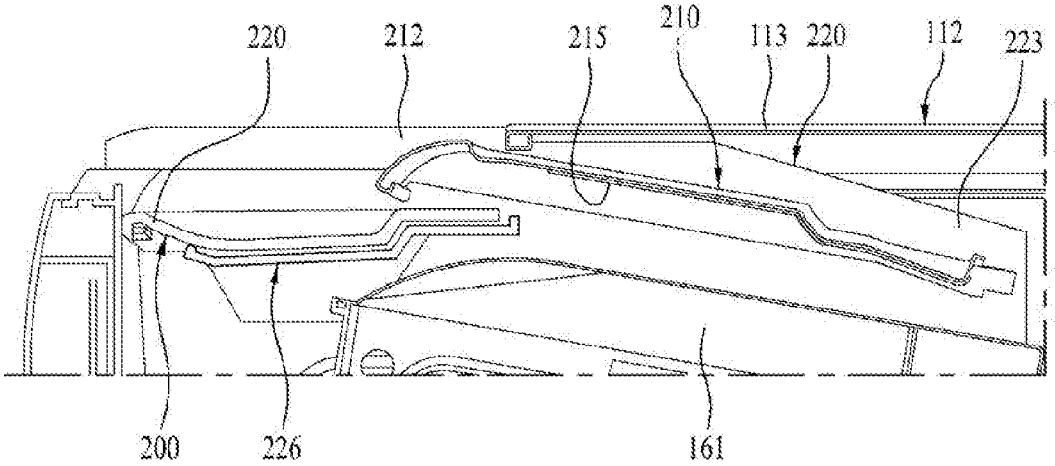

As shown in FIGS. 6 to 8, dispenser cover 200 according to the embodiment of the present invention includes a bracket 220, which is disposed over detergent dispenser 300' installed inside washing machine 100, and a sliding door 210, which is guided by bracket 220 and is moved to a position under upper cover 112 so as to open detergent dispenser 300' when sliding door 210 is open.

Detergent dispenser 300' and upper cover 112 are spaced apart from each other by a predetermined distance so as to allow sliding door 210 of dispenser cover 200 to be easily moved.

Sliding door 210 is positioned at the upper surface of the front part of washing machine 100 and is positioned in front of upper cover 112 so as not to be covered by upper cover 112. The outer surface of sliding door 210 is flush with the upper surface of the upper cover 112.

Specifically, upper cover 112 is provided at the upper surface thereof with recessed surface 113 for reinforcing upper cover 112, and sliding door 210 is provided at the upper surface thereof with a recessed surface 211, which is flush with recessed surface 113 of upper cover 112.

Accordingly, the upper surface of washing machine 100 exhibits a single recessed shape composed of recessed surface 113 of upper cover 112 and recessed surface 211 of sliding door 210.

The front edge of sliding door 210 is provided with connecting surface 212, which is continuous with the contour of front cover 117 of cabinet 110. In other words, the front edge of sliding door 210 constitutes the front and upper edge of washing machine 110.

That is, sliding door 210 may be provided at the front edge thereof with connecting surface 212 having a predetermined curved shape, and the upper surface of sliding door 210 may be continuous with the front surface of front cover 117 via the curved surface of connecting surface 212.

Alternatively, connecting surface 212 of sliding door 210 may be constituted by an inclined surface having a predetermined angle of inclination. If the front edge of sliding door 210 has an inclined surface, the front edge of washing machine 100 may be constituted by three flat or curved surfaces, namely door 210, connecting surface 212 and front cover 117.

Sliding door 210 is provided at both lateral sides thereof with first and second slide protrusions 213 and 214, which are guided by bracket 220, which will be described later. First and second slide protrusions 213 and 214 are spaced apart from each other by a predetermined distance, and second slide protrusion 214 is positioned behind first slide protrusion 213.

Bracket 220 includes a body part 221, which is disposed over detergent dispenser 300', and guide parts 223, which are disposed on both lateral sides of body part 221 so as to slidably guide sliding door 210.

Body part 221 has one or more through holes 222 corresponding to detergent introduction hole 311, preliminary detergent introduction hole 312, subsidiary detergent introduction hole 512 and like, which are formed in detergent dispenser 300'.

The pair of guide parts 223 are vertically disposed at both lateral side ends of body part 221 and extend downward from upper cover 112. Guide parts 223 are provided in facing surfaces thereof with first and second guide slits 224 and 225, along which first and second slide protrusions 213, inserted therein, are guided.

First and second guide slits 224 and 225 are symmetrically formed in the inner surfaces of the pair of guide parts 223. First guide slit 224 is positioned in front of second guide slit 225.

First guide slit 224 and second guide slit 225 have different angles of inclination, and are inclined downward in the direction of upper cover 112. Second guide slit 225 preferably has a greater angle of inclination than first guide slit 224.

First slide protrusion 213 is inserted into first guide slit 224, and second slide protrusion 214 is inserted into second guide slit 225. Accordingly, when sliding door 210 slides, first and second protrusions 213 and 214 move along first and second guide slits 224 and 225, respectively.

First guide slit 224 and second guide slit 225 have different angles of inclination. The upper ends of first and second guide slits 224 and 225 extend such that sliding door 210 closes detergent dispenser 300' when first and second slide protrusions 213 and 214, inserted into first and second guide slits 224 and 225, are positioned at the upper ends of first and second slits 224 and 225.

The lower ends of first and second guide slits 224 and 225 extend such that sliding door 210 opens detergent dispenser 300' and moves to a position under upper cover 112 when first and second slide protrusions 213 and 214, inserted into first and second guide slits 224 and 225, are positioned at the lower ends of first and second guide slits 224 and 225.

Figure 10:
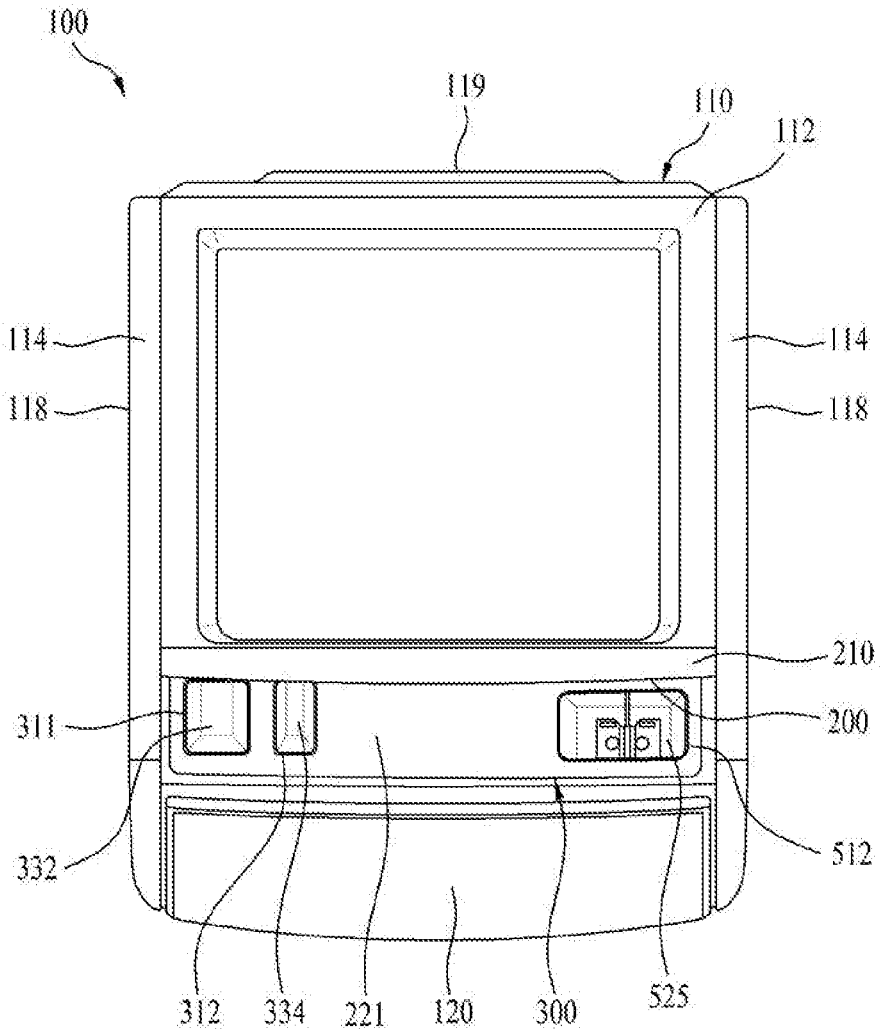

When detergent dispenser 300' is opened, sliding door 210 of dispenser cover 200 is moved to a position under upper cover 112. In other words, when sliding door 210 is moved to a position under upper cover 112, sliding door 210 comes very close to upper surface of duct 161 of air supply unit 160, as shown in FIG. 10.

When air supply unit 160 is operated while detergent dispenser 300' is not covered by sliding door 210 of dispenser cover 200, air supply unit 160 creates high-temperature air, and supplies the hot air to tub 130 and recovers the hot air from the tub so as to dry laundry.

At this time, duct 161 of air supply unit 160 generates high-temperature heat, and sliding door 210, which is close to duct 161, may thus be deformed due to the heat generated in duct 161.

Specifically, although sliding door 210 and bracket 220, which constitute dispenser cover 200, are usually made of a synthetic injection material, which is relatively resistant to heat, they may be deformed due to the high-temperature heat generated in duct 161 of air supply unit 160.

For this reason, sliding door 210 of dispenser cover 200 is provided on the lower surface thereof with a first thermal shield member 215 for preventing the heat generated in duct 161 of air supply unit 160 from being transferred to sliding door 210.

First thermal shield member 215 may be configured to have a shape corresponding to the shape of the lower surface of sliding door 210 such that first thermal shield member 215 is directly attached to sliding door 210 or is attached to sliding door 210 with a predetermined gap therebetween so as to decrease the coefficient of heat transfer.

In addition, body part 221 of bracket 220 is also provided on the lower surface thereof with a second thermal shield member 226 for preventing the heat generated from duct 161 of air supply unit 160 from being directly transferred to sliding door 210. Second thermal shield member 226 may also be configured to have a shape corresponding to the shape of the lower surface of bracket 220 such that second thermal shield member 226 is directly attached to bracket 220 or is attached to bracket 220 with a predetermined gap therebetween so as to decrease the coefficient of heat transfer.

Consequently, since the heat generated from duct 161 of air supply unit 160 is not directly transferred to bracket 220 or to sliding door 210 during or after the operation of air supply unit 160, it is possible to prevent thermal distortion of bracket 220 and sliding door 210.

The operation of dispenser cover 200 according to an embodiment of the present invention will now be described. In the initial state of dispenser cover 200, dispenser cover 200 closes detergent dispenser 300'.

Figure 9:
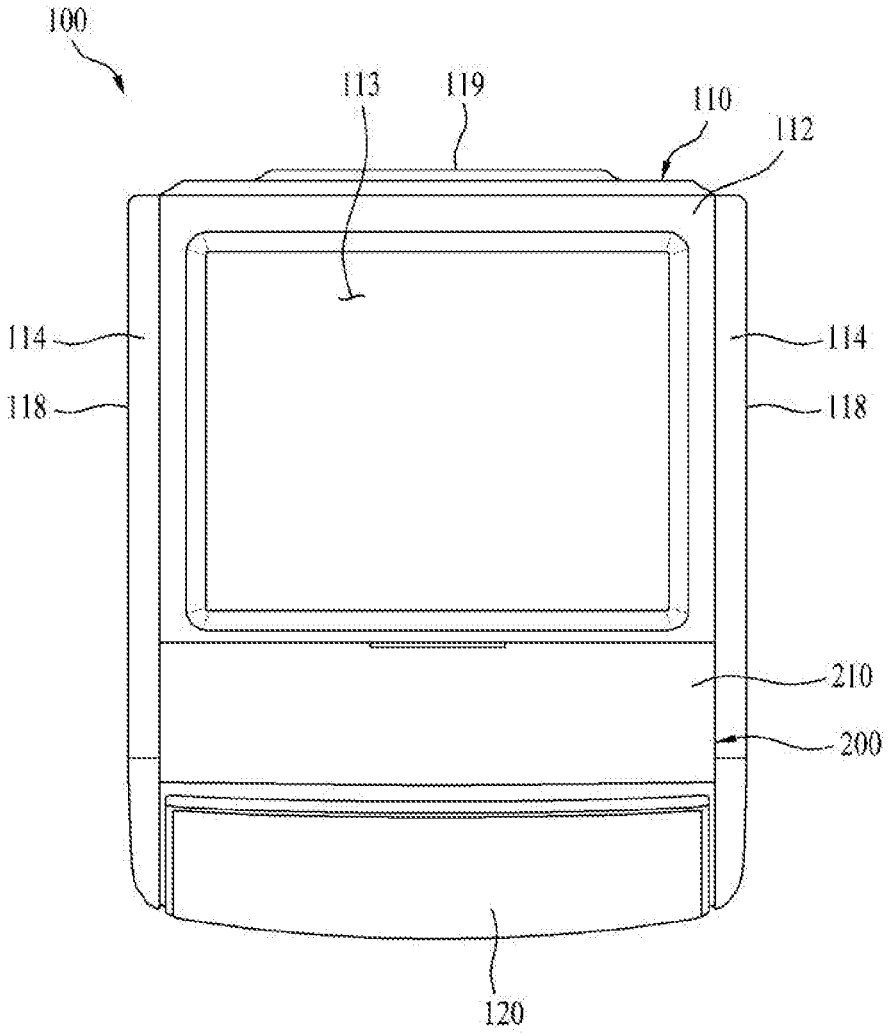
FIGS. 9 and 10 are plan views showing the motion of the dispenser cover according to the embodiment of the present invention.

In other words, sliding door 210 of dispenser cover 200 is removed from the position under upper cover 112 and is positioned over detergent dispenser 300' (see FIG. 9). At this time, first and second slide protrusions 213 and 214, which are formed on both lateral sides of sliding door 210, are positioned at the upper ends of first and second guide slits 224 and 225, which are formed in guide parts 223 of bracket 220, and front edge of sliding door 210 constitutes the front and upper edge of washing machine 100.

When sliding door 210 of dispenser cover 200 is pushed toward upper cover 112 in order to open detergent dispenser 300', first and second slide protrusions 213 and 214 of sliding door 210 move along first and second guide slits 224 and 225, formed in guide parts 223 of bracket 220, and sliding door 210 moves accordingly.

Here, first and second guide slits 224 and 225 are configured to be inclined downward as they move toward upper cover 112. Accordingly, as sliding door 210 moves to a position under upper cover 112, detergent dispenser 300' is opened (see FIG. 10).

In washing machine 100 according to the embodiment of the present invention, since detergent dispenser 300' is positioned on the upper part of washing machine 100 and dispenser cover 200, adapted to open and close detergent dispenser 300', is provided on the upper surface of washing machine 100, it is possible for a user to more easily introduce detergent into washing machine 100.

Furthermore, since washing machine 100 prevents the heat generated from the duct from being directly transferred to dispenser cover 200 during the drying procedure of washing machine 100, it is possible to prevent dispenser cover 200 from being damaged due to heat generated from air supply unit 160.

In addition, since upper cover 112 and dispenser cover 200, which define the upper surface of washing machine 100, are configured so as to be continuous with each other, the upper surface of washing machine 100 can appear as an integral component having a neat appearance.

As is apparent from the above description, the washing machine according to the present disclosure is characterized in that the position of the detergent dispenser is changed and the structure is improved, thereby allowing a user to easily introduce detergent into the washing machine.

Furthermore, since the washing machine according to the present disclosure is constructed to prevent heat from an air supply unit from being directly transferred to a dispenser cover adapted to open and close a detergent dispenser, it is possible to prevent thermal distortion of the dispenser cover.

In addition, since the washing machine according to the present disclosure is improved with respect to the position and structure of the detergent dispenser, it is possible to eliminate restrictions relating to the design of the washing machine.

It will be apparent to those skilled in the art that various modifications and variations can be made without departing from the spirit or scope of the invention. Thus, it is intended that the present disclosure covers the modifications and variations of this invention provided they come within the scope of the appended claims and their equivalents.

What is claimed is:

1. A washing machine, comprising:
- a tub;
- an air supply unit, disposed over the tub, to heat and circulate air in the tub;
- a detergent dispenser, disposed over the tub;
- a dispenser cover for opening the detergent dispenser; and
- a thermal shield member to prevent heat generated from the air supply unit from being directly transferred to the dispenser cover,
- wherein the dispenser cover comprises:
  - a bracket disposed over the detergent dispenser; and
  - a sliding door, which is slidably coupled to the bracket and which slides to open and close the detergent dispenser,
  - wherein the thermal shield member is attached to a lower surface of the bracket with a predetermined gap therebetween.

2. The washing machine of claim 1, further comprising:
- a cabinet including an upper cover defining a rear portion of an upper surface of the washing machine,
- wherein the detergent dispenser is not covered by the upper cover, and the dispenser cover is moved to a position under the upper cover to open the detergent dispenser.

3. The washing machine of claim 1, wherein the bracket comprises:
- a body part having a through hole through which detergent is introduced into the detergent dispenser; and
- guide parts, which are provided on both lateral sides of the body part and are provided on inner facing surfaces thereof with first and second guide slits for guiding the sliding door,
- wherein the sliding door includes first and second slide protrusions formed on both lateral sides thereof, which are inserted in the first and second guide slits, respectively.

4. The washing machine of claim 3, wherein the first and second guide slits are inclined downward in a direction in which the sliding door opens.

5. The washing machine of claim 3, wherein the second guide slits have a greater angle of inclination than the first guide slits.

6. The washing machine of claim 1, wherein a front edge of the sliding door constitutes a front edge of the cabinet, and a connecting surface is provided between an upper surface of the sliding door and a front cover of the cabinet so as to connect the upper surface of the sliding door to the front cover of the cabinet.

7. The washing machine of claim 1, wherein the air supply unit comprises:
- an introduction portion, disposed at a circumferential surface of a rear part of the tub;
- a discharge portion, disposed at a center of a front part of the tub; and
- a duct, connecting both the discharge portion and the introduction portion.

8. The washing machine of claim 7, wherein the dispenser cover is positioned over an upper surface of the duct when the detergent dispenser is open.

9. A washing machine, comprising:
- a cabinet including an upper cover defining a rear portion of an upper surface thereof;
- a tub disposed in the cabinet;
- an air supply unit, disposed over the tub, to heat and circulate air in the tub;
- a detergent dispenser, disposed over the tub, which is not covered by the upper cover;
- a dispenser cover, which is moved to a position under the upper cover to open the detergent dispenser; and
- a thermal shield member to prevent heat generated from the air supply unit from being directly transferred to the dispenser cover,
- wherein the dispenser cover comprises:
  - a bracket disposed over the detergent dispenser; and
  - a sliding door, which is slidably coupled to the bracket and which slides to open and close the detergent dispenser,
  - wherein the thermal shield member is attached to a lower surface of the bracket with a predetermined gap therebetween.

* * * * *